US006157277A

United States Patent [19]

Bulgatz et al.

[11] Patent Number: 6,157,277

[45] Date of Patent: Dec. 5, 2000

[54] ELECTROMAGNETIC ACTUATOR WITH IMPROVED LAMINATION CORE-HOUSING CONNECTION

[75] Inventors: Dennis Bulgatz, Williamsburg; James A. Nitkiewicz; Robert W. McFarland, both of Newport News; James P. Fochtman, Williamsburg, all of Va.

[73] Assignee: Siemens Automotive Corporation, Auburn Hills, Mich.

[21] Appl. No.: 09/204,174

[22] Filed: Dec. 3, 1998

Related U.S. Application Data

[63] Continuation-in-part of application No. 09/181,206, Oct. 28, 1998, Pat. No. 6,049,264.

[60] Provisional application No. 60/069,144, Dec. 9, 1997.

[51] Int. Cl.[7] ..... H01F 7/08

[52] U.S. Cl. ..... 335/220; 251/129.15

[58] Field of Search ..... 336/210, 234; 335/252, 276, 220–229; 123/90.11; 251/129.01–129.15

[56] References Cited

U.S. PATENT DOCUMENTS

| | | | |
|---|---|---|---|
| 3,110,874 | 11/1963 | Dowdle | 336/234 |
| 3,810,303 | 5/1974 | Hoell | 336/60 |
| 3,965,451 | 6/1976 | De Vos | 336/65 |
| 4,032,874 | 6/1977 | Kudlacik et al. | 336/210 |
| 4,131,867 | 12/1978 | Quioque | 336/65 |
| 4,240,056 | 12/1980 | Mayer | 335/267 |
| 4,715,331 | 12/1987 | Krueter | 123/90.11 |
| 5,476,079 | 12/1995 | Kanamori et al. | 123/458 |
| 5,548,263 | 8/1996 | Bulgatz et al. | 335/274 |
| 5,720,468 | 2/1998 | Morinigo | 251/129.1 |
| 5,819,397 | 10/1998 | Knight et al. | 29/605 |

FOREIGN PATENT DOCUMENTS 2595756 3/1986 France .

*Primary Examiner*—Lincoln Donovan

[57] ABSTRACT

An electromagnetic actuator is provided and includes upper and lower electromagnets. Each electromagnet includes a lamination core assembly comprising a plurality of individual stacked laminations. Upper and lower housings are provided, each having opposing end walls. The core assembly of the upper electromagnet is disposed between the end walls of the upper housing and the core assembly of the lower electromagnet is disposed between the end walls of the lower housing. An armature is mounted for movement between the core assemblies. Spacer structure is disposed between the core assemblies and contacts each of the core assemblies to prevent the core assemblies from moving towards each other. A pin provides a connection between a lamination core assembly and the end walls of an associated housing. Each housing has a contact surface between the end walls and each of the core assemblies includes a solid core member defining a central portion of each core assembly. Each of the solid core members is secured to a contact surface of an associated housing via at least one fastener.

15 Claims, 3 Drawing Sheets

ELECTROMAGNETIC ACTUATOR WITH IMPROVED LAMINATION CORE-HOUSING CONNECTION

This application claims the benefit of U.S. Provisional application No. 60/069,144, filed Dec. 9, 1997. This application is also a continuation-in-part of application No. 09/181,206 filed on Oct. 28, 1998 now 6,049,264.

FIELD OF THE INVENTION

This invention relates to an electromagnetic actuator for a vehicle engine and more particularly to a method of securing a lamination core assembly of the actuator to a housing of the actuator.

BACKGROUND OF THE INVENTION

A conventional electromagnetic actuator for opening and closing a valve of an internal combustion engine generally includes "open" and "close" electromagnets which, when energized, produce an electromagnetic force on an armature. The armature is biased by a pair of identical springs arranged in parallel. The armature is coupled with a cylinder valve of the engine. The armature rests approximately half-way between the open and close electromagnets when the springs are in equilibrium. When the armature is held by a magnetic force in either the closed or opened position (at rest against the open or close electromagnet), potential energy is stored by the springs. If the magnetic force is shut off with the armature in the opened position, the spring's potential energy will be converted to kinetic energy of the moving mass and cause the armature to move towards the close electromagnet. If friction is sufficiently low, the armature can then be caught in the closed position by applying current to the close electromagnet.

The open and close electromagnets of the above-described conventional electromagnetic actuator each include a lamination core assembly coupled to a housing. A coil is associated with each core assembly. Typically, the core assembly is composed of a plurality of individual laminations which are joined to define the core assembly. The core assembly is typically secured to the housing by straight pins. However, with straight pins, it is difficult to achieve a strong interference fit on both ends of the pin because the large installation force exerted on the pin can cause the pin to plastically deform. Further, the pins alone are not sufficient to prevent centrally located laminations of the core assembly from being forced in a direction away from the housing during operation of the of the actuator.

There is a need to provide a lamination core assembly-housing connection which is easy to manufacture, provides intimate contact between the housing and core assembly to facilitate heat transfer, and which prevents movement of the central portion of the core assembly when force is exerted thereon.

SUMMARY OF THE INVENTION

An object of the present invention is to fulfill the need referred to above. In accordance with the principles of the present invention, this objective is obtained by a method of joining a lamination core assembly of an electromagnetic actuator to a housing of the actuator. The method includes providing a lamination core assembly including a plurality of stacked laminations extending along a stacking axis. Each lamination has generally the same thickness in a direction along the stacking axis. The lamination core includes a solid core member having opposing ends. The solid core member is disposed generally centrally with respect to the plurality of stacked laminations such that each end of the solid core member contacts a lamination of the plurality of laminations. The solid core member has a thickness in a direction along the stacking axis substantially greater than the thickness of a lamination. The solid core member has at least one mounting bore therethrough disposed generally perpendicular to the stacking axis. The lamination core assembly has at least one bore therethrough disposed in the direction of the stacking axis. A housing is provided having opposing ends and a contact surface between the ends. Each of the opposing ends has a pin receiving aperture therein. The apertures are aligned axially. The contact surface includes a fastener receiving aperture therein.

The lamination core assembly is inserted into the housing such that a surface of the lamination core assembly engages the contact surface of the housing and with the bore in the lamination core assembly being aligned with the pin receiving apertures in the housing and with the mounting bore of the solid core member being aligned with the fastener receiving aperture in the housing. A fastener is inserted through the mounting bore of the solid core member to engage the fastener receiving aperture in the housing to secure the solid core member to the housing. A pin is inserted to extend through the bore in the lamination core and received in each of the pin receiving apertures in the housing in such a manner to provide an interference fit between at least one end of the pin and the housing at a pin receiving aperture.

In accordance with another aspect of the invention, an electromagnetic actuator is provided and includes upper and lower electromagnets. Each electromagnet includes a lamination core assembly comprising a plurality of individual stacked laminations. Upper and lower housings are provided, each having opposing end walls. The core assembly of the upper electromagnet is disposed between the end walls of the upper housing and the core assembly of the lower electromagnet is disposed between the end walls of the lower housing. An armature is mounted for movement between the core assemblies. Spacer structure is disposed between the core assemblies and contacts each of the core assemblies to prevent the core assemblies from moving towards each other. A pin provides a connection between a lamination core assembly and the end walls of an associated housing. Each housing has a contact surface between the end walls and each of the core assemblies includes a solid core member defining a central portion of each core assembly. Each of the solid core members is secured to a contact surface of an associated housing via at least one fastener.

Other objects, features and characteristic of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE INVENTION

Figure 1:
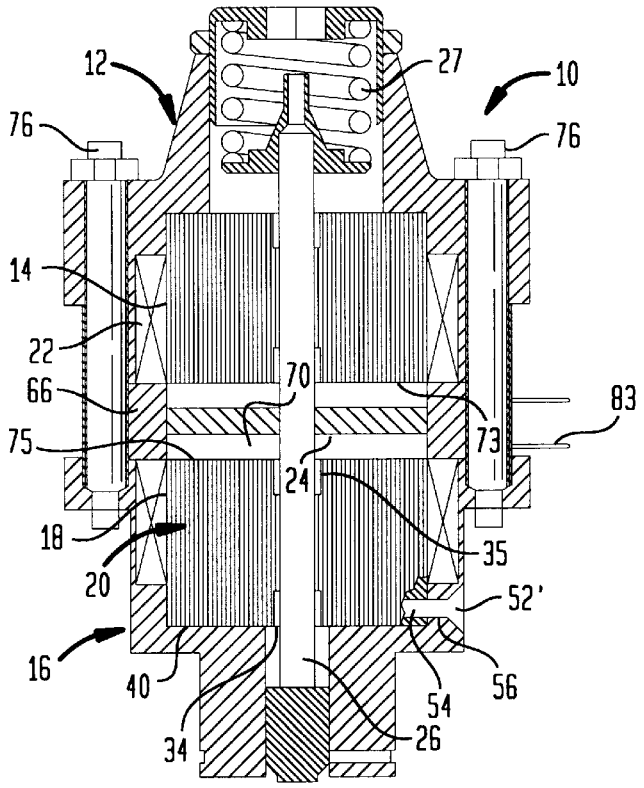
FIG. 1 is a cross-sectional view of an electromagnetic actuator provided in accordance with the principles of the present invention.

Referring to FIG. 1, an electromagnetic actuator is shown, generally indicated 10, provided in accordance with the principles of the present invention. The electromagnetic actuator 10 includes an upper housing, generally indicated at 12, containing an upper electromagnet 14, and a lower housing, generally indicated at 16, containing a lower electromagnet 18. The upper and lower housings 12 and 16 are preferable aluminum castings. Each electromagnet 14 and 18 includes a lamination core assembly, generally indicated at 20, and a coil assembly 22. An armature 24 is arranged for movement between the electromagnets 14 and 18. The armature 24 is carried by a reciprocating shaft 26. The shaft 24 is configured to be coupled to a stem of a gas exchange valve (not shown) of an engine of a vehicle in the conventional manner. In the typical manner, a pair of opposing springs are associated with the armature 24. One spring 27 is shown in FIG. 1. The other spring (not shown) is disposed near the gas exchange valve.

Figure 2:
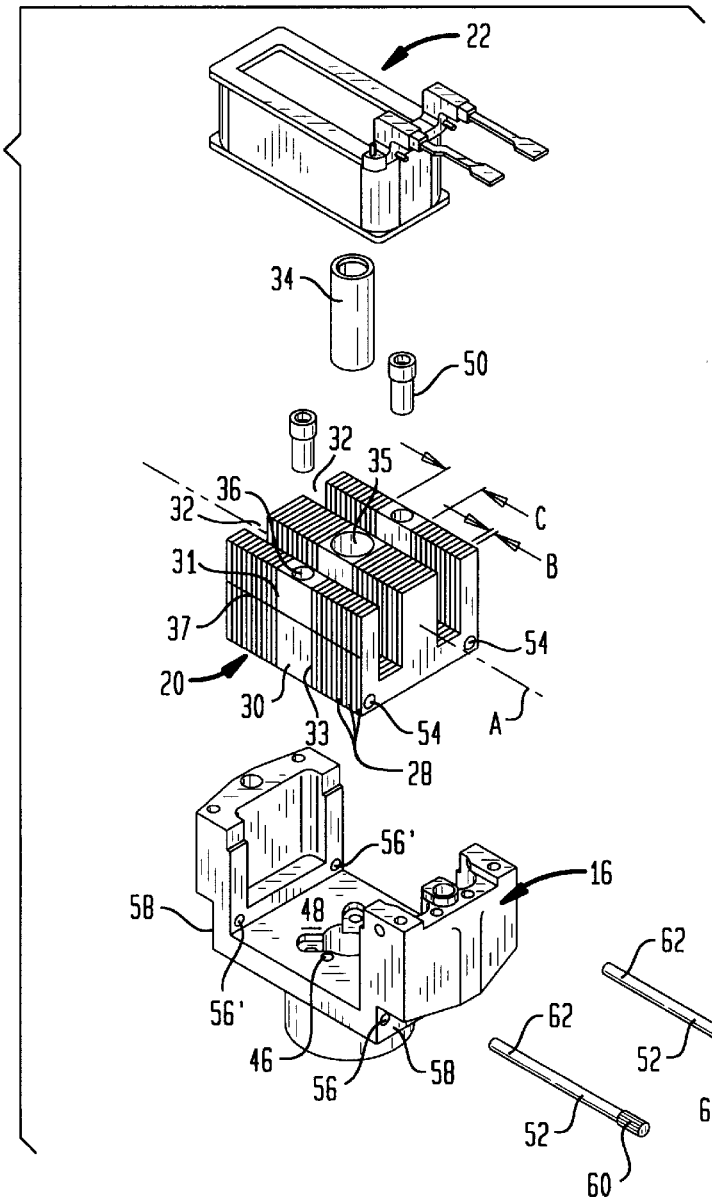
FIG. 2 is an exploded view of a lower electromagnet and housing assembly of an electromagnetic actuator of the present invention.

The invention will be described with regard to the lower electromagnet 18 and lower housing 16 as shown in FIG. 2. It will be appreciated, however, that the principles of the invention are applicable to the construction of the upper electromagnet 14 and upper housing 12 as well. Thus, with reference to FIG. 2, the lower electromagnet 18 includes a lamination core assembly 20 which is contained in the lower housing 16. The core assembly 20 comprises a plurality of laminations 28 stacked with respect to a stacking axis A. The laminations 28 generally have the same thicknesses B in a direction along the stacking axis A and are preferably composed of 29 gage M15 C5 soft magnetic material. Two laminations of the plurality laminations 28 contact opposing ends 31 and 33 of a solid center core member 30 such that the core member 30 is disposed generally centrally between the plurality of laminations 28. Each lamination 28 and the core member 30 is generally E-shaped defining channels 32 to receive an associated coil assembly 22.

Figure 3:
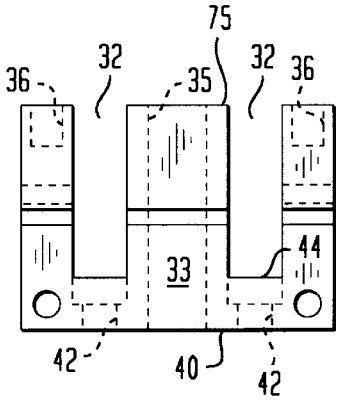
FIG. 3 is an end view of a solid core member of a lamination core assembly of the electromagnet of FIG. 2.

In accordance with the invention and with reference to FIGS. 2 and 3, the solid core member 30 has ends 31 and 33, a top surface 75 and a bottom surface 40. A thickness C of the core member 30, as defined between ends 31 and 33 or in a direction along the stacking axis, is substantially greater than a thickness B of the individual laminations 28. The solid core member 30 is preferably composed of silicon iron, and has a thickness C of about 8–12 mm. In the illustrated embodiment, the solid core member 30 is composed of 2.5% silicon iron and has a thickness of about 10 mm. The solid core member 30 also includes a center aperture 35 therethrough extending from the top surface 75 to the bottom surface 40. The aperture 35 receives a bushing 34, press-fitted therein. Thus, the aperture 35 is disposed generally perpendicular to the stacking axis A. The bushing 34 supports the reciprocating shaft 26 (FIG. 1).

The laminations 28 and solid core member 30 may be secured together by a weld 37 on each side thereof. It can be appreciated that the laminations 28 may be joined in any other conventional manner, such as, for example, an interlocking or mechanical upset arrangement, gluing, riveting or a combination of these techniques. After assembly, the top and bottom surfaces the core assembly 20 are machined so as to be substantially parallel.

In accordance with the invention and with reference to FIGS. 2 and 3, the solid core member 30 includes a mounting bore 42 through the wall 44 which defines a bottom of each channel 32. In addition, a pair of threaded, fastener receiving apertures 46 are provided in the bottom or contact surface 48 of the lower housing 16 arranged to align with the mounting bores 42 when the core assembly 20 is placed into the lower housing 16. A cap screw 50 is inserted into each mounting bore 42 and is engaged with an associated threaded aperture 46 to securely fasten the core assembly 20 with respect to the lower housing 16. The bores 42 are countersunk such that when a fastener is inserted into each bore 42, the head of the fastener does not extend into the channel 32, thus permitting the coil assembly 22 to be inserted into the channels 32. Although, in the illustrated embodiment, a pair of screws is provided, it is within the contemplation of the invention to provide a single screw or fastener, or to provide more than two screws or fasteners.

In addition, pins 52 are disposed through axially extending bores 54 in the core assembly 20 and into pin receiving apertures 56 and 56' in each end wall 58 of the lower housing 16 to further secure the core assembly 20 to the housing 16. In the embodiment of FIG. 2, each pin has a head 60 which has a diameter greater than the remainder of the pin 52 including end 62 thereof. The diameter of at each aperture 56 is sized slightly less than the diameter of the heads 60, while the diameter of each aperture 56' is sized to provide a small clearance when the end 62 of each pin 52 is inserted therein. Thus, when the pins 52 are inserted, there is an interference fit with the heads 60 and the housing 16 at apertures 56 and a small clearance is provided between the ends 62 of the pins 52 and the housing 16 at apertures 56'. The larger diameter of the head 60 of the pins 52 allows a larger area for interference than does a constant diameter pin. Thus, a stronger joint is provided. For best possible heat transfer, the core assembly 20 should be in intimate contact with the aluminum housing 16. The head 60 of each pin 52 is used to press the core assembly 20 against the opposite sides of the housing 16 which ensures good heat transfer. In addition, the location of the apertures 56 and 56' in the housing 16 can be toleranced such that the bottom surface of the core assembly 20 engages the contact surface 48 of the housing 16. The pins 52 can be manufactured inexpensively by a cold heading process. Various possible finishes on the cylindrical head surface from knurling to splines may be employed to enhance the mechanical strength of the connection. Although in the illustrated embodiment, a pair of pins 52 is provided, it is within the contemplation of the invention of provide a single pin or more than two pins.

Figure 4:
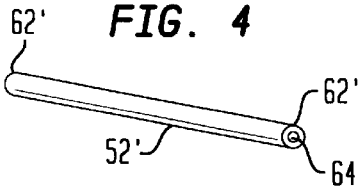
FIG. 4 is a perspective view of a second embodiment of a pin employed to secure a lamination core assembly to a housing of the electromagnetic actuator of the invention.

A second embodiment of pins of the invention is best shown in FIGS. 1 and 4. Instead of providing headed pins, the pins 52' have a constant diameter and each end 62' has a small countersink 64 therein. In this case, apertures 56 and 56' have generally the same diameter and are sized to receive the ends 62 of the pin 52'. The pins 52' are secured to the housing 17 by upsetting the ends 62' thereof. For example, a tapered punch can be driven into each countersink 64 of each pin 52' to expand each end 62' into the aluminum housing 16, as best shown in FIG. 1.

The use of pins 52 or 52' and the screws 50 to fasten the lamination core assembly 20 to each housing 12 and 16 advantageously prevents the core assemblies 20 from moving away from the associated housing and towards the armature 24 during operation of the actuator 10. Since the center core member 30 is anchored to the housing via the screws, the pins are supported at their centers by a the solid core member 30 and are unsupported in only in the individual lamination portion of the core assembly 20. The unsupported length of the pins is thereby reduced to less than half of its value if individual laminations were provided in place of the solid core member 30. Because the stiffness of a pin is a function of the cube of its length, the rigidity of the core assembly-housing connection is increased substantially.

Figure 5:
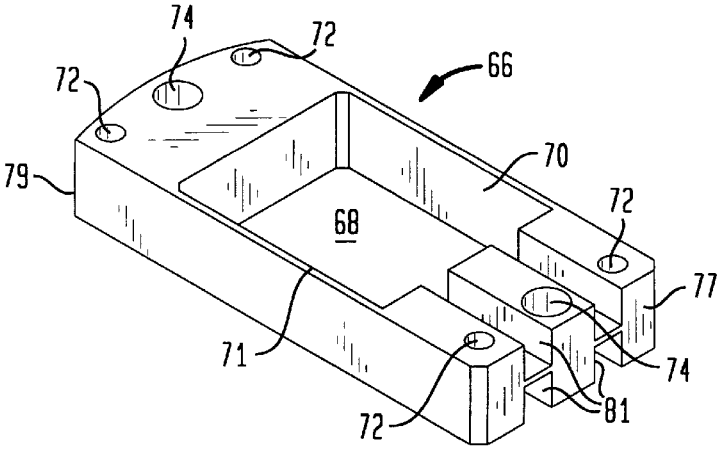
FIG. 5 is an enlarged perspective view of a spacer block of the actuator of FIG. 1.

With reference to FIGS. 1 and 5, to further enhance the mechanical strength of the core assembly 20 and housing 16 joint, spacer structure, generally indicated at 66, separates the upper housing 12 and the lower housing 16 and thus separates the core assemblies 20 as well. As shown in FIG. 5, the spacer structure 66 is generally in the form of a spacer block having two side walls 70 and 71 and opposing end walls 77 and 79. The spacer block also has an opening 68 therein sized to permit the armature 24 to move therein. The side walls 70 and 71 contact opposing faces 73 and 75 of the upper and lower core assembly 20, respectively, and prevent the core assembles 20 from moving toward each other during operation of the actuator 10. The spacer block 66 includes housing mounting apertures 72 for receiving a fastener to permit the lower housing 16 to be coupled to the upper housing 12 and mounting bores 74 to permit a bolt 76 (FIG. 1) to be inserted therethrough for mounting the actuator 10 to a structure. In addition channels 81 are provided in the spacer block 66 to accommodate electrical leads 83 (FIG. 1) of the electromagnets.

Since the spacer block 66 surrounds the armature 24, the armature 24 is substantially prevented from rotating with respect to the shaft 26, noise of the actuator 10 can be reduced and the entry of dirt and dust in the area of the armature 24 can be reduced.

Figure 6:
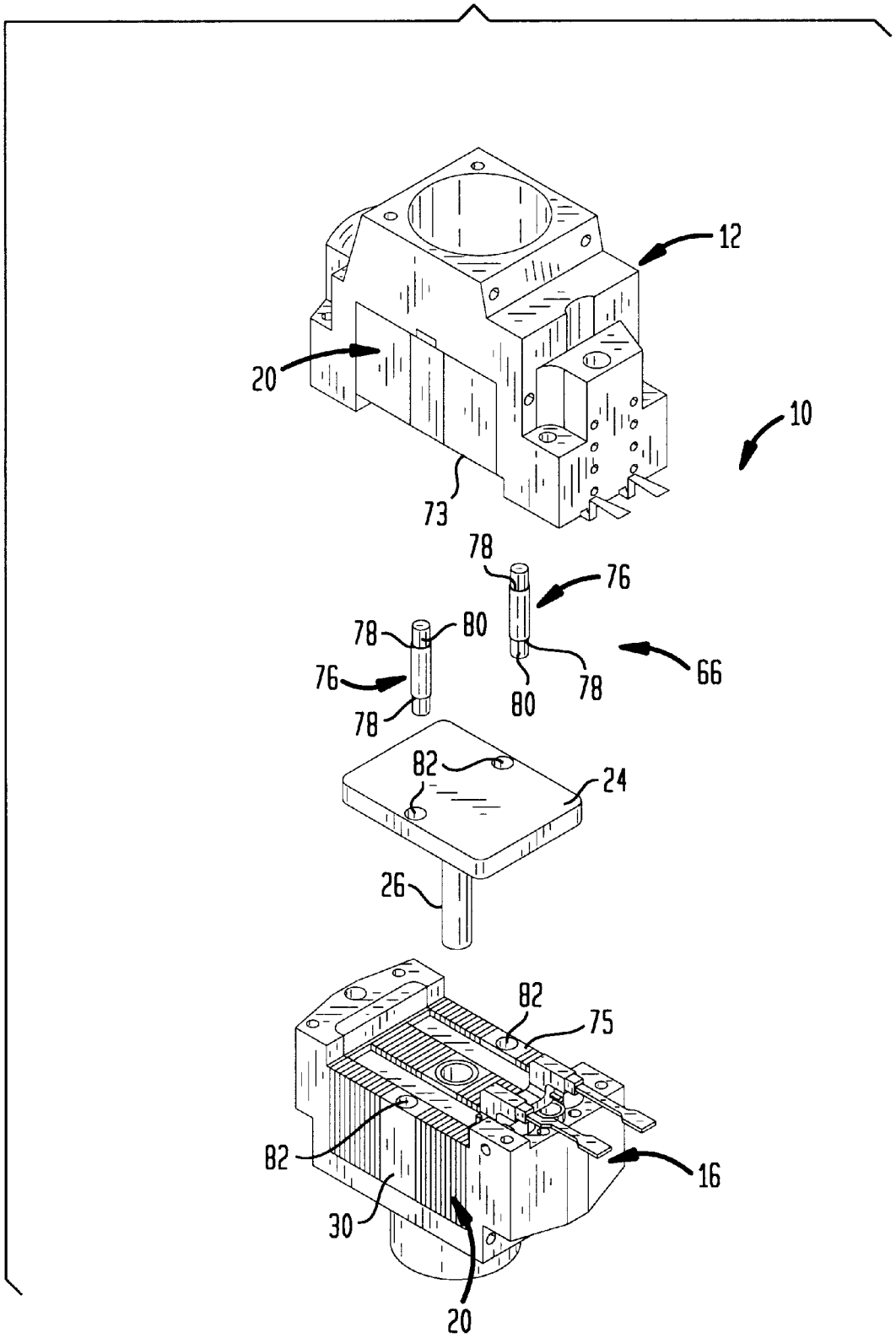
FIG. 6 is a perspective view of a second embodiment of an electromagnetic actuator of the invention having core spacer pins.

With reference to FIG. 6, a second embodiment of the spacer structure 66 is shown. The spacer structure in this embodiment is in the form of cylindrical spacer pins, generally indicated at 76. The shoulders 78 of the pins 76 rest on surfaces 73 and 75 of the upper core assembly and lower core assembly 20, respectively. The smaller diameter portion 80 at each end of pin 76 is inserted into an associated bore 82 in the core member 30 of each core assembly 20 and can be used to align the upper and lower housings during assembly. The pins 76 can be made hollow in order to be part of an oil distribution system of the actuator 10. Another function of the pins 76 is to prevent rotation of the armature 24. Bores 84 or slots are provided through the armature 24 and are sized to receive the larger diameter portion of each pin 76 and thus prevent the armature 24 from rotating around the shaft 26.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. An electromagnetic actuator comprising:

upper and lower electromagnets, each electromagnet including a lamination core assembly comprising a plurality of individual laminations in stacked relation, upper and lower housings each having opposing end walls, the core assembly of said upper electromagnet being disposed between the end walls of said upper housing and the core assembly of said lower electromagnet being disposed between the end walls of said lower housing, an armature mounted for movement between said core assemblies, spacer structure disposed between said core assemblies and contacting each said core assembly to prevent said core assemblies from moving towards each other, and a pin providing a connection between each lamination core assembly and the end walls of an associated housing.

2. An electromagnetic actuator comprising:

upper and lower electromagnets, each electromagnet including a lamination core assembly comprising a plurality of individual laminations in stacked relation along a stacking axis, upper and lower housings each having opposing end walls, the core assembly of said upper electromagnet being disposed between the end walls of said upper housing and the core assembly of said lower electromagnet being disposed between the end walls of said lower housing, an armature mounted for movement between said core assemblies, spacer structure disposed between said core assemblies and contacting each said core assembly to prevent said core assemblies from moving towards each other, and a pin providing a connection between each lamination core assembly and the end walls of an associated housing, wherein each housing has a contact surface between the end walls and each of said core assemblies includes a solid core member having a thickness greater than a thickness of each of said individual laminations, the core member defining a central portion of each core assembly, each of said solid core members being secured to a contact surface of an associated housing via at least one fastener.

3. The actuator according to claim 2, wherein each of said solid core members has a mounting bore therethrough in a direction perpendicular to the stacking axis, said contact surface of each of said housings having a threaded aperture therein and a said fastener being received in each said mounting bore and being in threaded engagement with an associated threaded aperture.

4. The actuator according to claim 2, wherein said spacer structure has a pair of opposing end walls and a pair of opposing side walls, said spacer structure having an opening therethrough to receive said armature with said end walls and side walls surrounding said armature and surfaces of said side walls contacting surfaces of said core assemblies.

5. The actuator according to claim 2, wherein said spacer structure is in the form of a pair of spacer pins, each spacer pin being of cylindrical form and having opposing ends, said armature having a pair of bores therethrough to receive said spacer pins, a respective end of each spacer pin being coupled to a respective solid core member.

6. The actuator according to claim 5, wherein each of said spacer pins has a shoulder at each end thereof, each of said shoulders resting on a surface of a respective solid core member.

7. The actuator according to claim 1, wherein each pin is constructed and arranged so that said connection is defined by deforming ends of each pin which are disposed within associated apertures defined in the end walls of said housings.

8. The actuator according to claim 1, wherein each of said pins includes first and second ends, said second end defining a head having a diameter greater than a diameter of said first end, said connection being defined by an interference fit with said second end of said pins and associated apertures in the end walls of said housings.

9. The actuator according to claim 1, where each lamination core assembly is of E-shape.

10. An electromagnetic actuator comprising:

upper and lower electromagnets, each electromagnet including a lamination core assembly comprising a plurality of individual laminations in stacked relation along a stacking axis and a solid core member, said solid core member defining a central portion of each core assembly and having a thickness greater than a thickness of an individual lamination, upper and lower housings each having opposing end walls, the core assembly of said upper electromagnet being disposed between the end walls of said upper housing and the core assembly of said lower electromagnet being disposed between the end walls of said lower housing, each of said solid core members being secured to an associated housing via at least one associated fastener, an armature mounted for movement between said core assemblies, and a pin providing a connection between a lamination core assembly and the end walls of an associated housing.

11. The actuator according to claim 10, wherein each of said core members has a mounting bore therethrough in a direction perpendicular to the stacking axis, a surface of each of said housings having a threaded aperture therein and a said fastener being received in each said mounting bore and being in threaded engagement with an associated said threaded aperture.

12. The actuator according to claim 10, wherein each pin is constructed and arranged so that said connection is defined by deforming ends of each pin which are disposed within associated apertures defined in the end walls of said housings.

13. The actuator according to claim 10, wherein each of said pins includes first and second ends, said second end defining a head having a diameter greater than a diameter of said first end, said connection being defined by an interference fit between said second end of the pins and associated apertures in the end walls of said housings.

14. The actuator according to claim 1, wherein said spacer structure has a pair of opposing end walls and a pair of opposing side walls, said spacer structure having an opening therethrough to receive said armature with said end walls and side walls surrounding said armature and surfaces of said side walls contacting surfaces of said core assemblies.

15. The actuator according to claim 1, wherein said spacer structure is in the form of a pair of spacer pins, each spacer pin being of cylindrical form and having opposing ends, said armature having a pair of bores therethrough to receive said spacer pins, a respective end of each spacer pin being coupled to a respective core assembly.

* * * * *